United States Patent [19]

Kondo et al.

[11] 4,386,252

[45] May 31, 1983

[54] GANGED PUSH-BUTTON SWITCH

[75] Inventors: Shiro Kondo; Michitada Akazawa, both of Furukawa, Japan

[73] Assignee: Alps Electric Co., Ltd., Tokyo, Japan

[21] Appl. No.: 271,264

[22] Filed: Jun. 8, 1981

[30] Foreign Application Priority Data

Jun. 9, 1980 [JP] Japan ..... 55-80223[U]

[51] Int. Cl.[3] ..... H01H 13/74

[52] U.S. Cl. ..... 200/296; 200/5 E; 200/50 C

[58] Field of Search ..... 200/295, 296, 303, 153 J, 200/159 R, 5 B, 5 E, 5 EA, 50 C; 248/27.1, 27.3

[56] References Cited

U.S. PATENT DOCUMENTS

| | | | |
|---|---|---|---|
| 2,223,673 | 12/1940 | Catron et al. | 200/295 |
| 3,501,599 | 3/1970 | Horecky | 200/295 |
| 3,783,204 | 1/1974 | Kennedy et al. | 200/5 EB |
| 4,016,387 | 4/1977 | Aberer | 200/303 |
| 4,227,163 | 10/1980 | Barnoski | 200/159 R |
| 4,297,541 | 10/1981 | Niinuma | 200/5 E |

*Primary Examiner*—John W. Shepperd

*Attorney, Agent, or Firm*—Guy W. Shoup; Gerard F. Dunne

[57] ABSTRACT

A ganged push-button switch assembly having a plurality of switch blocks mounted in a common frame. Each switch block has an operation rod movable inwardly beyond a latchable position, a casing adapted to fit in corresponding mounting opening formed in the frame and a cover member attached to the casing and slidably receiving the operation rod. The casing has resilient arms adapted for engagement with the mounting opening of the frame, while the cover member has a pair of retainers engageable with the casing and is provided at its portion projecting forwardly from the frame with a groove which receives an engaging portion projected from an interlocking plate common to the switch blocks.

3 Claims, 5 Drawing Figures

GANGED PUSH-BUTTON SWITCH

BACKGROUND OF THE INVENTION

The present invention relates to a construction of ganged push-button switch and, more particularly, to a less expensive ganged push-button switch having a simple construction which permits repair or renewal of switch blocks from the operation side, i.e. front side, of the ganged push-button switch.

As will be explained in detail later with reference to attached FIG. 1, a conventional ganged push-button switch requires a special jig for bending fixing claws used to fix respective switch blocks to a frame. Thus, for assembling different ganged push-button switches having different pitches of mounting of switch blocks, it is necessary to use different jigs suited for different pitches. In addition, if one or more of the switch blocks have failed, it is necessary to bend back the fixing claws using a special jig for demounting the switch blocks. Then, the repaired switch blocks or new switch blocks are mounted and fixed again by bending the fixing claws again. This mounting and demounting operation has to be made with greatest care, for otherwise the claws may be broken due to repeated bending and stretching. The ganged push-button switch as a whole becomes unusable, even by a breaking of only one of the fixing claws.

SUMMARY OF THE INVENTION

Accordingly, an object of the invention is to provide a novel ganged push-button switch free from the above-described problems of the prior art.

To this end, according to the invention, there is provided a ganged push-button switch assembly having a plurality of push-button switches each of which having an operation rod movably inwardly of the switch to the inner side of a latchable position, the assembly having an interlocking plate common for said switches, each of the switches having a casing fitted in an opening formed in a metallic frame common to the switches and a cover member in which the operation rod is slidable, wherein the improvement comprises that the casing has a pair of resilient arms adapted for engagement with the opening of the frame, and that the cover member has a pair of retainers engageable with the casing and is provided at its portion projected forwardly from the frame with a groove which receives an engaging portion projected from the interlocking plate.

The above and other objects, as well as advantageous features of the invention will become clear from the following description of the preferred embodiments taken in conjunction with the accompanying drawings.

DESCRIPTION OF THE PREFERRED EMBODIMENTS

Before turning to the detailed description of the preferred embodiment, an explanation will be made as to a typical conventional ganged push-button switch assembly, in order to facilitate the understanding of the problems of the prior art and, hence, the advantage of the present invention.

Figure 1:
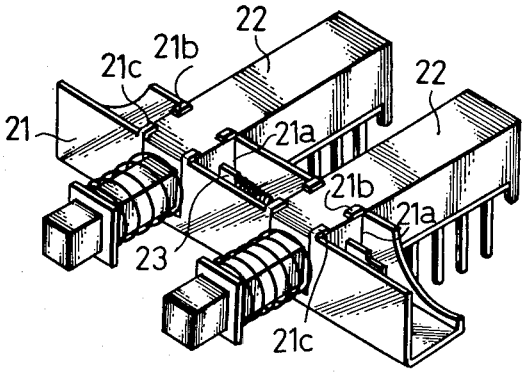
Fig.1 PRIOR ART
FIG. 1 is a perspective view of a conventional ganged push-button switch assembly.

Referring to FIG. 1, a typical conventional ganged push-button switch has a substantially U-shaped frame 21 made of a metallic plate and provided with a multiplicity of recesses 21*a* each receiving a switch block 22. An interlocking cam plate 23 is disposed in relation to each switch block 22. Each recess 21*a* is provided with fixing claws 21*c* which are plastically bent to fix the associated switch block in the recess 21*a* of the frame 21.

Thus, in assembling this conventional ganged push-button switch, it is necessary to use a special jig for bending the claws 21*b*, for fixing the switch blocks 22 in the U-shaped frame 21. For assembling a plurality of ganged push-button switch assemblies having different mounting pitches of the switch blocks, it is necessary to prepare a plurality of jigs suited for these pitches. In the event of a failure in one or more switch blocks of the switch assembly, it is necessary to demount the failed switch block or blocks and to mount the repaired switch blocks or new switch blocks on the frame again. To this end, it is necessary to straighten or stretch the fixing claws employing a special jig to permit the demounting of the switch blocks and to bend the fixing claws again after the mounting of the repaired or new switch blocks. This work has to be done with greatest care, for otherwise the fixing claws may be broken due to repeated bending and straightening. The ganged push-button switch assembly as a whole becomes unusable even by a breaking of only one of the fixing claws.

Figure 2:
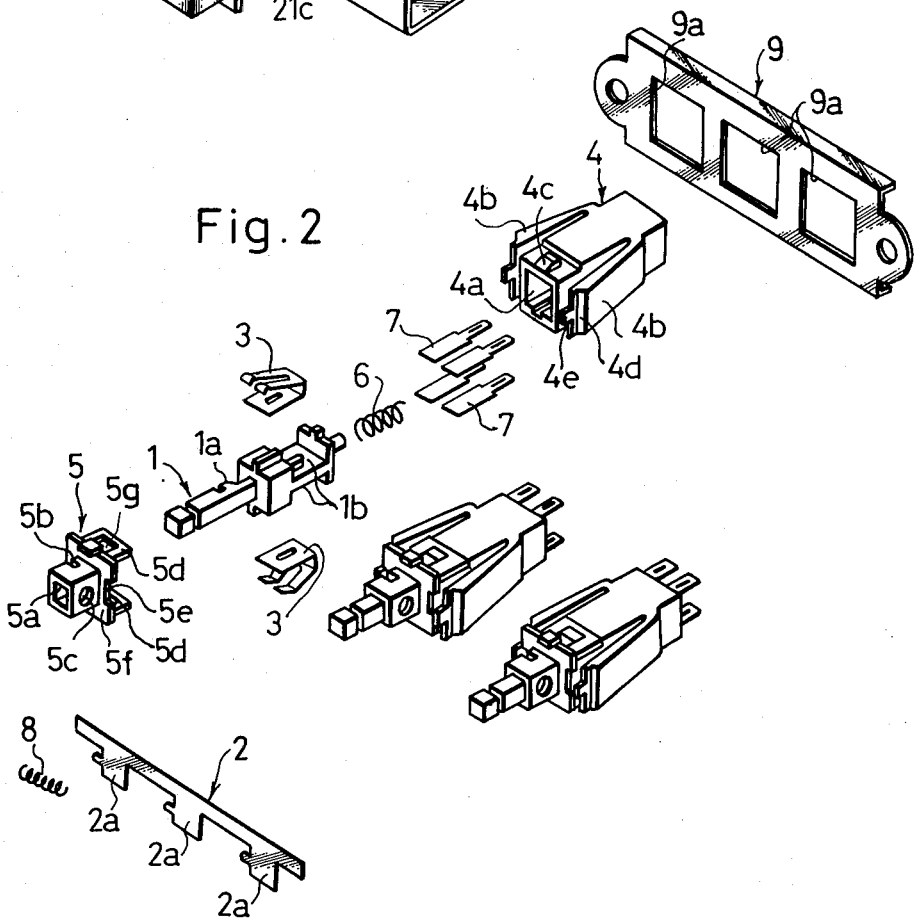
FIG. 2 is an exploded perspective view of a ganged push-button switch assembly constructed in accordance with an embodiment of the invention.
Figure 3A:
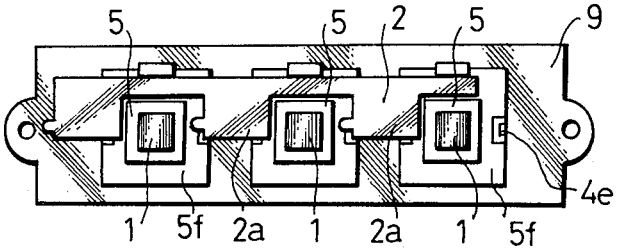
FIGS. 3(*a*) and 3(*b*) are front elevational views of the ganged push-button switch assembly as shown in FIG. 2.
Figure 3B:
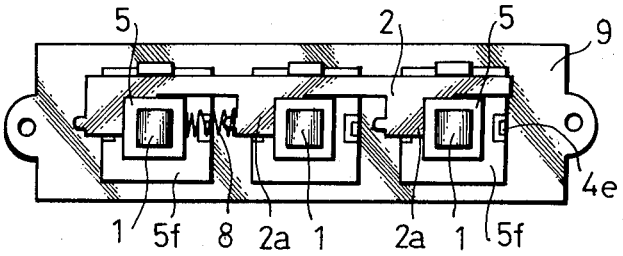
Figure 4:
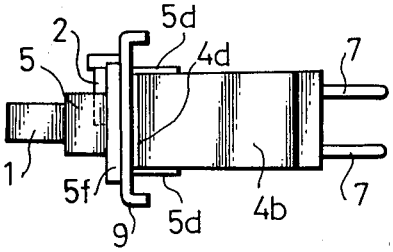
FIG. 4 is a side elevational view of the ganged push-button switch assembly as shown in FIG. 2.

This problem is completely overcome by the present invention, as will be understood from the following description of a preferred embodiment taken in conjunction with FIGS. 2 to 4. Referring to these Figures, a reference numeral 1 denotes an operation rod made of a synthetic resin and provided with a projection portion 1*a* for engaging an interlocking plate 2. Also, upper and lower recesses 1*b*, are formed in the operation rod 1 so as to receive movable contacts 3,3. A reference numeral 4 designates a casing also made from a synthetic resin and provided with an opening 4*a* for receiving the operation rod 1. A pair of resilient arms 4*b*,4*b* are formed on opposing walls of the casing 4. Also, on another pair of opposing walls of the casing 4, are formed a pair of projections 4*c* and 4*c*. Each resilient arm 4*b* is provided with an abutment 4*d* and a tab 4*e*.

A cover member 5 made of a synthetic resin has an opening 5*a* for receiving the operation rod 1, a groove 5*b* for receiving an engaging portion 2*a* of the interlocking plate 2, a recess 5*c* for receiving a coiled spring, spaced retainers 5*d*, 5*d* and a flange 5*f* provided with a cut-out portion 5*e* in which the tab 4*e* of the resilient arm 4*e* is placed. Each retainer 5*d* is provided with an engaging opening 5*g*. A reference numeral 6 designates a resetting coiled spring, 7 denotes a fixed contact provided on the bottom of the switch case 4, and 8 denotes a coiled spring for biasing the interlocking plate in one direction. A metallic frame 9 is formed by punching a blank from a metal sheet and then suitably bending the punched blank, and is provided with rectangular opening 9*a* for receiving respective switch blocks.

The ganged push-button switch assembly of this embodiment is assembled in the following procedure. After fixing the fixed terminals 7 in the casing 4, the resetting coiled spring 6 is inserted into the casing 4 and, thereafter, the operation rod 1 with the movable contacts 3,3 fitted in the recesses 1*b*,1*b* thereof is inserted in the casing. Thereafter, the cover member 5 is fitted to the casing 4. Then, after insertion of the operation rod into the opening 5*a* in the cover member 5, the retainers 5*d*,5*d* are brought into engagement with the projections 4*c*,4*c* of the casing 4, thus completing the assembling of one switch block. The switch block is then fitted in the corresponding rectangular opening 9*a* of the frame 9, so that the switch block is fixed by the engagement between the resilient arms 4*b*,4*b* of the casing 4 and the flange 5*f* of the cover case 5.

Subsequently, the interlocking plate 2 is secured to the frame 9 mounting the switch blocks. As will be seen from FIG. 3(*a*), the interlocking plate 2 is fitted from the front side of the frame 9 such that the engaging portion 2*a* of the interlocking plate 2 is positioned in the groove 5*b* of the cover case 5, with the coiled spring 8 disposed between the engaging portion 2*a* and the recess 5*c* of the cover member 5 as shown in FIG. 3(*b*).

In this state, the engaging portion 2*a* of the interlocking plate 2 can be brought into and out of engagement with the projection portion 1*a* of the operation rod 1. The assembling of the ganged push-button switch is thus completed.

The demounting of the switch block, if necessary for repair or renewal, can be made in a manner explained hereinunder. First of all, the coiled spring 8 urging the interlocking plate 2 is detached and the latter is moved to the position shown in FIG. 3(*a*). In this state, the interlocking plate 2 can be detached from the assembly. Thereafter, the tabs 4*e*,4*e* on the resilient arms 4*b*,4*b* of the switch case 4 positioned in the cut-out portion 5*e* are deflected inwardly to disengage the abutments 4*d*,4*d* of the resilient arms 4*b*,4*b* from the frame 9. In this state, the switch block can be drawn out simply by being pulled forwardly.

As has been described, according to the invention, there is provided a ganged push-button switch assembly which permits an easy mounting and dismounting to and from the frame and in which the interlocking plate is mounted at the front side to facilitate the mounting and demounting thereof. In this ganged push-button switch assembly, therefore, the mounting and demounting for repair or renewal of the switch blocks can easily be made from the front side of the mounting panel or the like. In addition, this ganged push-button switch assembly having simple construction can be produced at a reduced cost of production.

What is claimed is:

1. A ganged push-button switch having a plurality of push-button switch blocks each having an operation rod movable inwardly of the respective switch block to latchable position, the assembly having an interlocking plate common to said switch blocks and each of said switch blocks having a casing fitted in a respective opening formed in a metallic frame common to said switch blocks and a cover member in which said operation rod is slidable, wherein the improvement comprises that the casing for each switch block had a pair of resilient arms adapted for engagement with the respective opening of said frame, and that said cover member has a pair of retainers engageable with said casing and is provided at its portion projected forwardly from said frame with a groove which receives an engaging portion projected from said interlocking plate.

2. A ganged push-button switch assembly as claimed in claim 1, wherein said casing has a pair of projections formed on the side surfaces thereof perpendicular to said resilient arms, while said retainers formed on said cover member have engaging openings, whereby said cover member is secured to said casing with said engaging openings engaging with said retainers.

3. A ganged push-button switch assembly as claimed in claim 2, wherein each of said resilient arms is provided at its end with a tab formed unitarily therewith, said cover member has an angular flange provided with a pair of cut-out portions therein, whereby, after mounting of said casing and said cover member on the frame, said tabs project forwardly from said frame through respective cut-out portions of said flange.

* * * * *